United States Patent [19]

Lee

[11] Patent Number: 4,458,474

[45] Date of Patent: Jul. 10, 1984

[54] LEVEL WIND SPINNING WHEEL

[76] Inventor: Robert W. Lee, 24451 S. Central Point Rd., Canby, Oreg. 97013

[21] Appl. No.: 422,734

[22] Filed: Sep. 24, 1982

[51] Int. Cl.[3] ..... D01H 7/24; D01H 3/00

[52] U.S. Cl. ..... 57/71; 57/316

[58] Field of Search ..... 57/316, 67–71, 57/115–117

[56] References Cited

U.S. PATENT DOCUMENTS 2,143,203 1/1939 Maxham ..... 57/71 X 2,623,347 12/1952 Bishop ..... 57/70

OTHER PUBLICATIONS

Alden Amos's, "Spinning Wheel Primer", 1976.

Spin–Off Quarterly Newsletter, Dec. 1981, p. 2.

*Primary Examiner*—John Petrakes

*Attorney, Agent, or Firm*—Klarquist, Sparkman, Campbell, Leigh & Whinston

[57] ABSTRACT

A level wind spinning wheel has an improved flyer assembly wherein a level wind mechanism is incorporated in one arm of the flyer in such a way that the arm is free at one end for direct drive and axial removal of the bobbin. The arm comprises a rigid hollow tube extending parallel to the flyer spindle and having a cross-threaded journaled rod for rotation in its ends. A proximal end of the tube is supportingly connected to the spindle via a transverse member, which carries a gear train for rotating the rod. A traveler mounted on the rod carries an eye which protrudes through a lengthwise slot in the tube. A bobbin received on the spindle has a first gear which drives, through the gear train, a second gear mounted concentrically on the rod within the proximal end of the tube. The tube encloses and supports the cross-threaded rod and second gear. The slot retains the traveler eye against rotation on the rod as the traveler moves back and forth along the rod to uniformly wind yarn onto the bobbin.

4 Claims, 8 Drawing Figures

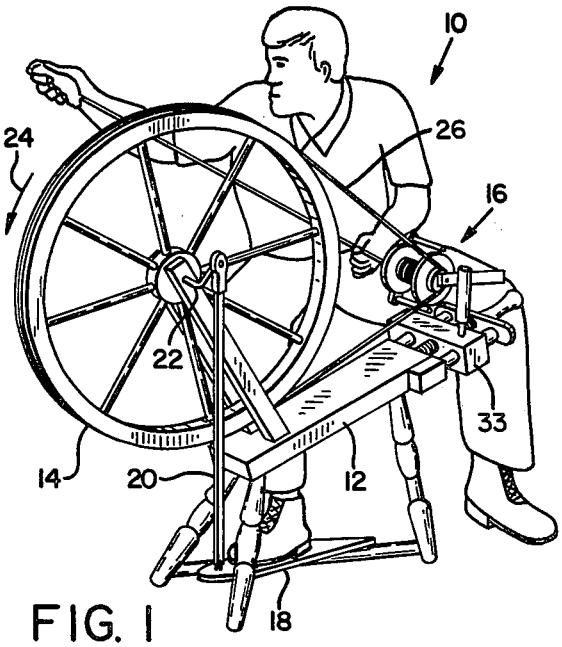
FIG. 1
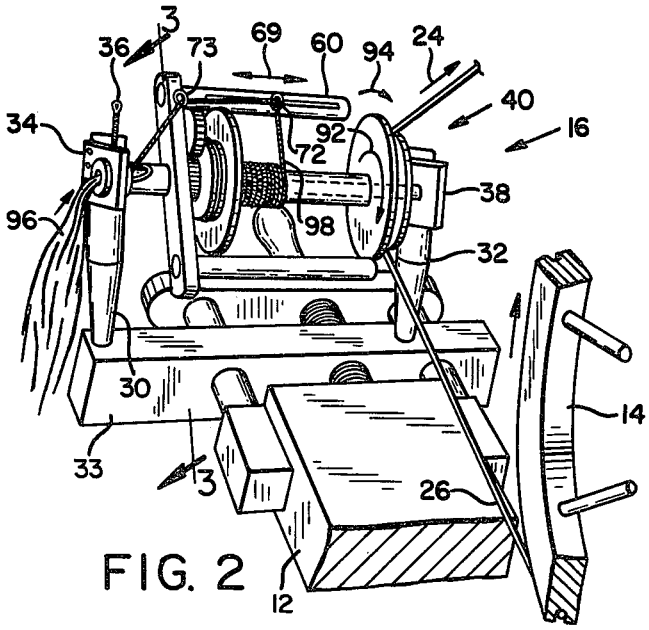
FIG. 2
FIG. 4
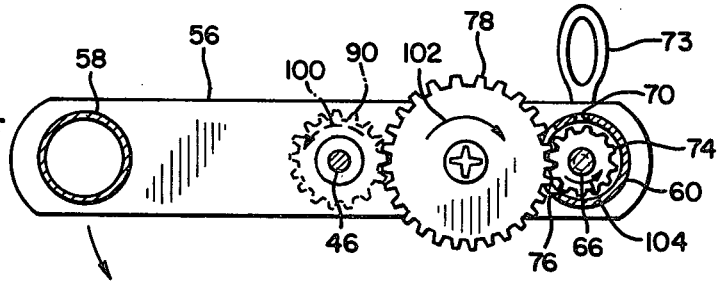
FIG. 3
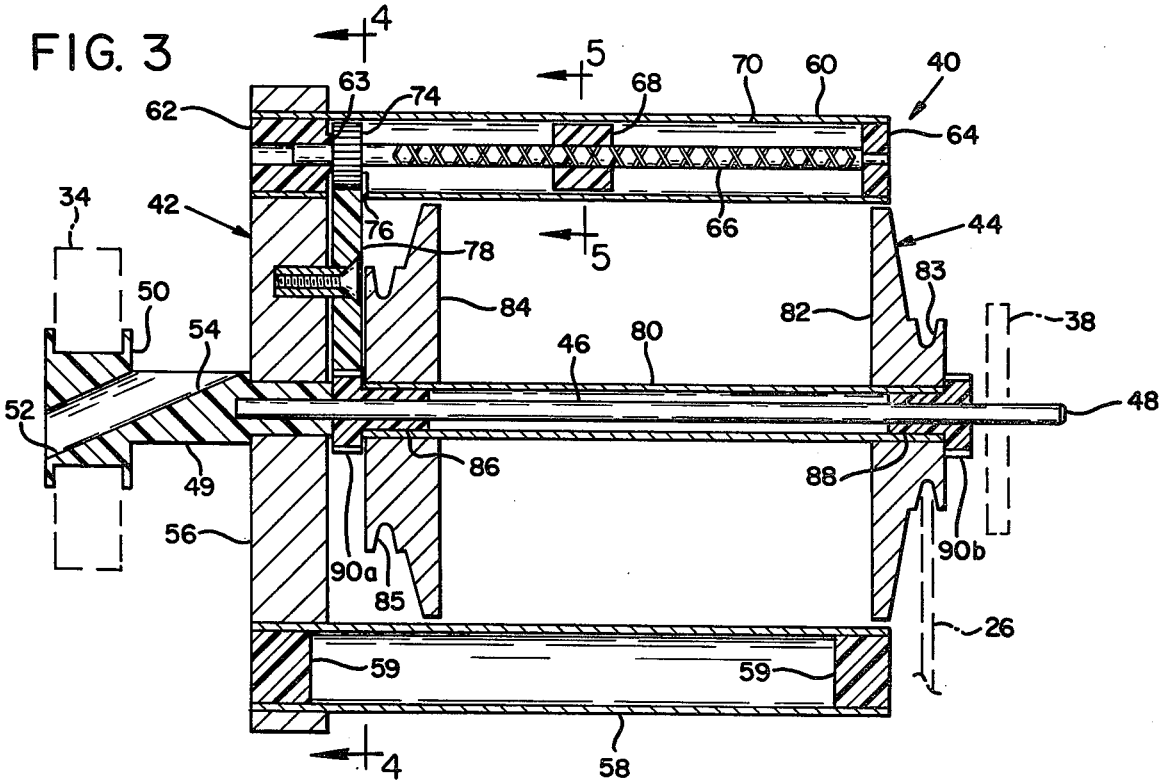

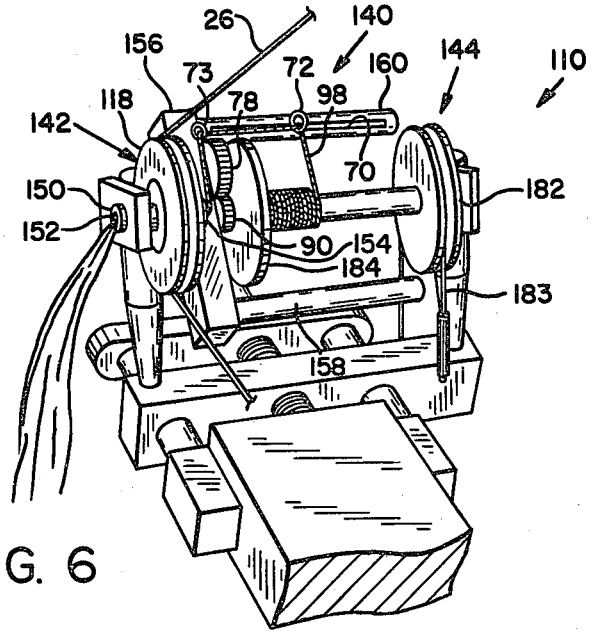
FIG. 6
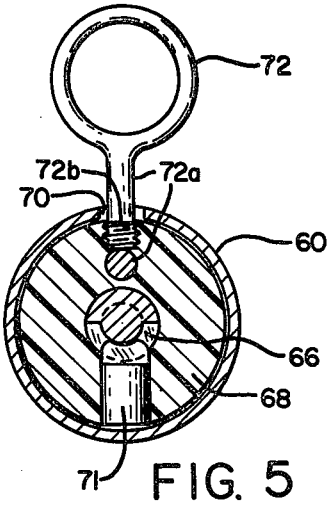
FIG. 5
FIG. 7
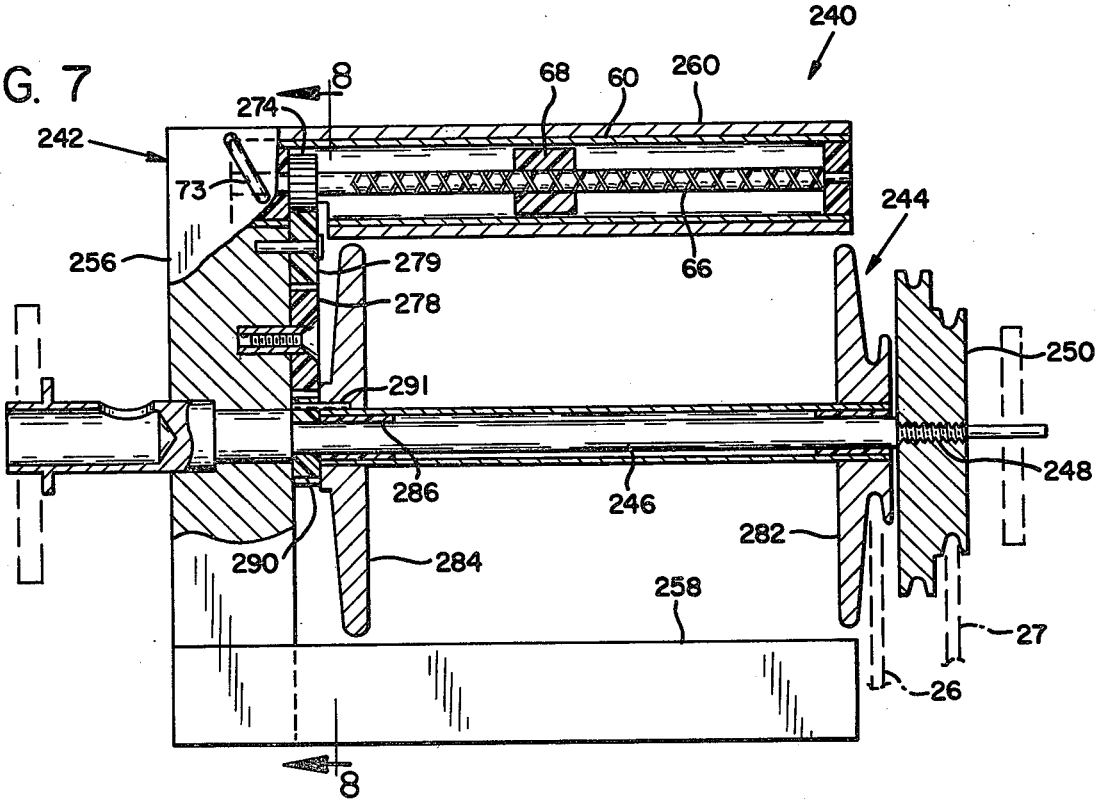
FIG. 8
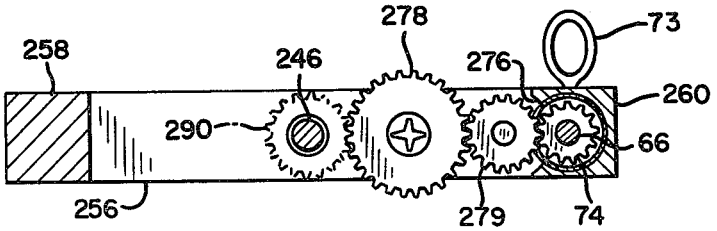

LEVEL WIND SPINNING WHEEL

BACKGROUND OF THE INVENTION

This invention relates generally to spinning wheels and more particularly to a spinning wheel flyer assembly adapted for level winding of yarn onto a bobbin during spinning.

The heart of a spinning wheel is its flyer assembly. As disclosed in Alden Amos, "Spinning Wheel Primer," 1976, a conventional flyer assembly in a manually-operated spinning wheel includes a flyer and a bobbin. The flyer comprises a spindle mounting a U-shaped member symmetrically connected to the base of the spindle. Conventionally, a row of hooks is distributed along one or both arms of the flyer to guide the yarn to a selected axial position along the bobbin. Alternatively, a single hook is mounted on a sleeve which is manually slidable along the arm. The spindle provides rotational support for the bobbin and includes an axial orifice in its base for introducing unspun fiber, such as wool, into the machine.

The flyer assembly is rotated to spin the fiber entering the orifice into yarn. The spun yarn is wound onto the bobbin, which rotates relative to the flyer to draw yarn through the hooks onto the bobbin. The bobbin draws the yarn outwardly through a radial opening in the side of the orifice structure and along one arm of the flyer, guided by the hooks. To wind yarn onto a different axial position along the bobbin, the yarn is shifted from one hook to another along the length of the arm.

It is desirable to wind the spun yarn onto the bobbin as uniformly as possible to get as much yarn on the bobbin before it is full and to facilitate winding the yarn off the bobbin into a skein after the bobbin is full. Doing so requires the spinner to periodically interrupt spinning in order to manually shift the yarn from one hook to another. A few highly skilled spinners can, by spinning at very high speed, cause the yarn to loop from one hook to another without stopping spinning. However, few spinners have this ability. For most spinners, it would be preferable to have some means for automatically level winding yarn onto the bobbin without having to interrupt spinning.

One attempt at poviding a level wind means is the level wind Ashford spinning wheel, disclosed in SPIN-OFF Quarterly Newsletter, page 2, December 1981. This machine utilizes a special mother-of-all or spinning head frame member designed to automatically shift the bobbin axially back and forth along the flyer spindle while the yarn feeds in through a fixed set of guide eyes. However, this system is complex, requires relatively radical and expensive changes to the structure of the spinning wheel and is vulnerable to breakdown problems.

Another approach to providing level winding means in a spinning wheel is disclosed in U.S. Pat. No. 2,623,347 to Bishop. Bishop's design propose a flyer assembly wherein a cross-threaded sleeve is mounted for rotation on one arm of the flyer. A traveler is threaded on the sleeve for axial movement back and forth, as the sleeve is rotated, to move an eye guiding the thread axially along the bobbin to level wind the thread onto the bobbin. The sleeve has a drive sheave mounted at one end which is driven by a pulley connected to a sheave freely rotatable on the spindle, positioned at the end of the bobbin opposite the orifice structure.

Although succeeding in level winding the yarn onto the bobbin, the structure proposed by Bishop suffers from several drawbacks. First, it cannot readily be used in the most common forms of spinning wheels. The flyer of Bishop is a rectangular wire frame structure closed at both ends and supported for rotation on a fixed spindle. The more commonly-used forms of spinning wheels utilize a flyer having a rotatable spindle and a U-shaped arm structure which is open at one end and connected to the spindle for rotation therewith. That is, the flyer arms and spindle are free at their ends remote from the orifice so that the bobbin can be easily removed axially from the spindle. Such arms do not provide the structural integrity to support a tensioned pulley drive at their free ends. And to close the free ends of the flyer arms would greatly impair the installation and removal of bobbins from the spindle. For similar reasons, the level wind flyer assembly of Bishop cannot be used in a single or dual drive bobbin-lead spinning wheel—its pulley and closed frame preclude directly driving the bobbin.

Another drawback of Bishop's design is that the level wind mechanism, requiring lubrication, rapidly gathers lint from the fiber being spun and thus requires frequent cleaning to prevent the threads in the sleeve from becoming plugged and rendering the level wind mechanism inoperative.

A further difficulty with the Bishop design is that constant tension must be maintained on the yarn during spinning to prevent the traveler from rotating with the sleeve and winding the yarn around the sleeve. This limitation prevents the level wind mechanism of Bishop from being used with the long draw technique of spinning. That technique is preferred for high-production spinning. Rather than applying steady tension to the yarn, the long draw technique calls for intermittently tensioning and then releasing long segments of yarn for winding onto the bobbin. Using this technique in the Bishop level wind flyer assembly would be disastrous. Apart from limitations on the spinning technique that can be used, the requirement that the yarn be continuously tensioned in the Bishop flyer assembly makes it more difficult for inexperienced spinners to learn to spin, because it adds another constraint to rather than simplifying the process of spinning.

Accordingly, there remains a need for an improved level wind mechanism for spinning wheels.

SUMMARY OF THE INVENTION

It is therefore one object of the invention to improve upon prior level wind spinning wheels.

Another object of the invention is to incorporate a level wind capability into flyer assemblies having free-ended flyer arms.

A further object of the invention is to provide a level wind flyer assembly which can be readily installed in a conventional spinning wheel without otherwise altering the structure of the wheel.

Yet another object of the invention is to provide a level wind flyer assembly which is usable in spinning wheels of all conventional types.

Other objects of the invention as aforesaid include:

1. enabling a level wind flyer assembly to be readily used with any spinning technique;

2. avoiding wrapping the yarn around the level wind mechanism; and 3. minimizing the need to clean the level wind mechanism.

In accordance with the invention, the foregoing objects are realized in a flyer assembly wherein one of the flyer arms is a rigid hollow member, free at one end, housing a cross-threaded rod which is journaled for rotation within the ends of the arm. The arm has a lengthwise slot through which protrudes an eye mounted on a traveler threaded on the rod to travel back and forth along the arm as the rod turns to distribute yarn along the bobbin. The bobbin is mounted for rotation on the flyer spindle and is easily removable axially of the spindle between the free ends of the flyer arms. A rotational drive means disposed along the transverse member of the flyer, that is, its orifice end, drivingly interconnects the bobbin and the cross-threaded rod. The drive means is preferably a gear train including a first gear mounted on one or both end faces of the bobbin, a second gear mounted concentrically on the cross-threaded rod, and one or more intermediate gears mounted for rotation on the transverse member of the flyer in position to mesh between the first and second gears.

This arrangement provides rigid support for the level wind mechanism without having to close or otherwise brace the free ends of the flyer. It also provides protection of the level wind mechanism from lint and dirt. Additionally, it prevents rotation of the traveler around the cross-threaded rod when, for example, the long draw spinning technique is used. The use of gears rather than pulleys enables the bobbins to be quickly exchanged. This level wind flyer assembly can be used in single drive spinning wheels, either bobbin lead or flyer lead type, or in dual drive bobbin lead spinning wheels.

The foregoing and other objects, features and advantages of the invention will become more readily apparent from the following detailed description of a preferred embodiment which proceeds with reference to the accompanying drawings.

BRIEF DESCRIPTION OF DRAWINGS

FIG. 1 is a perspective view from one side of a single drive bobbin lead spinning wheel incorporating a level wind flyer assembly in accordance with the invention.

FIG. 2 is an enlarged perspective view from the wheel end of the spinning wheel of FIG. 1 showing the flyer assembly in greater detail.

FIG. 3 is a longitudinal sectional view taken along lines 3—3 in FIG. 2.

FIG. 4 is a transverse sectional view taken along lines 4—4 in FIG. 3, the bobbin being removed and the bobbin gear being shown in phantom lines.

FIG. 5 is a cross-sectional view taken along line 5—5 in FIG. 3.

FIG. 6 is a view similar to that of FIG. 2 of a single drive flyer lead level wind flyer assembly in accordance with the invention.

FIG. 7 is a view corresponding to that of FIG. 3 showing a dual drive bobbin lead, level wind flyer assembly in accordance with the invention.

FIG. 8 is a transverse sectional view taken along lines 8—8 in FIG. 7, the bobbin being removed and its gear being shown in phantom lines.

DETAILED DESCRIPTION OF A PREFERRED EMBODIMENT

Single Drive Bobbin Lead Wheel

Referring to FIG. 1, a spinning wheel 10 has a frame 12 supporting a wheel 14 at one end and a spinning head 16 at the opposite end. A treadle 18 is connected via a pitman 20 to a crank 22 on wheel 14 for rotating the wheel, as indicated by arrow 24. The particular form of wheel illustrated in FIG. 1 is a Saxon wheel. The invention can be incorporated into other types of wheels, for example, the upright wheel disclosed in the aforementioned Bishop patent. In a single drive spinning wheel, wheel 22 drives a single pulley 26. In a dual drive wheel, wheel 22 additionally drives a second pulley 27, as shown in FIG. 7.

Referring to FIG. 2, spinning head 16 comprises a pair of upright members or maidens 30, 32 spaced laterally apart on a transverse frame member 33, conventionally referred to as a "mother-of-all." Positioned in the upper end of maiden 30 is a bearing mount 34 with a variable friction adjustment screw 36. Similarly positioned in the upper end of maiden 32 is a spindle end plate 38 with a spindle hole coaxially aligned with bearing holder 34. Removably mounted in bearing holders 34, 38 is a flyer assembly 40.

Referring to FIG. 3, the flyer assembly comprises a flyer 42 and a bobbin 44. The flyer includes a spindle 46 having a distal end portion 48 received axially in the spindle hole in plate 38 and a proximal end portion or base 49 terminating in a bearing 50 which is removably supported for rotation in bearing holder 34. Disposed within and extending axially through the spindle base is an orifice having an axial entrance 52 in the end face of bearing 50 and a radial outlet opening 54 on opposite side of bearing 50, adjacent the flyer structure next described.

A rigid U-shaped structure, comprising a transverse member 56 and a pair of parallel spaced-apart arms 58, 60 mounted on the ends of the transverse member, is connected to the spindle base axially adjacent orifice outlet opening 54. Transverse member 56 is a wooden member, in which arms 58, 60 are inserted and glued in position parallel to the spindle. Arm 58 is a hollow metal tube having end plugs 59 in its ends. Arm 60 is similarly a hollow metal tube having plugs 62, 64 fitted in its ends.

Incorporated in arm 60, in accordance with the invention, is a level wind mechanism comprising a cross-threaded rod 66 having its ends journaled in end plugs 62, 64. Received on rod 66 within tube 60 is a traveler 68, best seen in FIG. 5, which moves back and forth along rod 66 as the rod rotates. A pawl 71 carried by the traveler engages the threads and reverses direction of the traveler when it reaches the end of the threaded portion of the rod. A slot 70 extends lengthwise along arm 60. An eye 72, mounted detachably on traveler 68 by means of a L-shaped stem 72*a* and set screw 72*b*, protrudes through the slot for guiding yarn along the outside of the tube. A second eye 73 is fixed to the transverse member 56 laterally adjacent arm 60.

Referring to FIGS. 3 and 4, a spur gear 74, having a diameter slightly less than the inside diameter of tube 60, is mounted on rod 66. Such gear is positioned adjacent the insertion of tube 60 into transverse member 56, in abutment with a bearing surface formed by an annular shoulder 63 of end plug 62. A rectangular opening 76 is formed in a side of tube 60 adjacent gear 74. Opening 76 is positioned on the side of the tube facing the spindle 46 and extends circumferentially about one third of the way around tube 60. A relatively larger diameter spur gear 78 is mounted on transverse member 56 for rotation about an axis parallel to spindle 46 and rod 66 and is positioned to mesh with gear 74 through opening 76.

Bobbin 44 comprises a tubular shaft 80 with disks 82, 84 concentrically mounted on its opposite ends. Inserted in each end of tube 80 and surrounding spindle 46 is an annular bushing 86, 88 having a T-shaped cross section. External to tube 80, each of these bushings includes a radially-extending annular flange toothed on its periphery to form spur gears 90*a*, 90*b* at each axial end of the spindle. Both gears are sized to mesh interchangeably with gear 78. End disk 82 has a small whorl 83 for turning the bobbin at a fast speed when positioned adjacent spindle end 48 for connection to pulley 26, as shown in FIG. 3. The bobbin can be reversed to position a larger whorl 85 on end disk 84 in alignment with the spinning wheel for driving the bobbin at a slow speed. In either bobbin position, the gear train is operable to drive the level wind mechanism.

Gears 74, 78, 90*a*, 90*b*; bushings 86, 88; and end plugs 59, 62, 64 are preferably made of ultra-high molecular weight plastic, hard nylon or other low friction material. Plugs 59 in arm 58 are sized to counterbalance arm 60 and the level wind mechanism.

In operation, pulley 26 rotates bobbin 44 as indicated by arrow 92 in FIG. 2. Friction of the bobbin through bushings 86, 88 tends to rotate the flyer 42 in the same direction, as indicated by arrow 94. This rotation is braked by the friction of bearing mount 34 engaging bearing 50, so that the flyer rotates at a slower speed than the bobbin. Rotation of the flyer causes fiber 96 extending into orifice 52, 54 to be twisted into yarn. The relatively faster rotation of bobbin 44 causes the yarn to be drawn through eyes 72, 73 and wound onto the bobbin. The same relative rotation causes gear 90 on the bobbin to rotate relative to the flyer, as indicated by arrow 100 in FIG. 4. Gear 90 counterrotates gear 78, as indicated by arrow 102, which in turn rotates gear 74 and shaft 66, as indicated by arrow 104. Rotation of threaded shaft 66 causes traveler 68 to move back and forth along the rod, as indicated by arrow 69 in FIG. 1, to distribute yarn 98 lengthwise along bobbin shaft 80. Tension on fiber 96 can freely be relaxed, as in the long draw spinning technique, without adverse consequences, as the slot 70 is tube 60 maintains the eye 72 in a fixed angular position. To replace the bobbin when full, the flyer is removed from bearing members 34, 38 and the bobbin is simply pulled axially from the spindle shaft, the teeth of gears 78, 90 disengaging axially, and a new bobbin is installed by reversing these steps.

In addition to a single drive bobbin lead spinning wheel, the invention can be incorporated into other types of spinning wheels, as next described.

Single Drive Flyer Lead Wheel

Referring to FIG. 6, in a single drive flyer lead spinning wheel 110, the flyer assembly 140 has a whorled drive disk 118 mounted on flyer 142 between transverse arm 56 and bearing 150 for connection to pulley 26. The orifice 152 extends axially through disk 118 and has a radial outlet opening 154 extending through a side of transverse member 156. A bobbin 144 is mounted on the spindle (not shown) of flyer 142 in the same manner as described above for flyer assembly 40. Bobbin 144 has a whorled disk 182 only at its end remote from transverse member 156 and has a plain disk 184 at its end adjacent such member. Rotation of the flyer by pulley 26 tends to rotate the bobbin. An adjustable tension strap or belt 183 extends from the spinning wheel frame around disk 182 to act as a brake on the bobbin so that the bobbin rotates at a slower speed than the flyer. The flyer has arms 158, 160 which are substantially identical in structure to arms 58, 60 in flyer assembly 40, like parts being indicated by like reference numerals. Because the driven element is the flyer, the bobbin need not be reversible and therefore has a gear 90 only at one end.

Dual Drive Bobbin Lead Wheel

Referring to FIG. 7, a dual drive bobbin lead flyer assembly 240 is arranged for separately driving the flyer 242 and bobbin 244 via two pulleys 26, 27, driven by a single wheel (not shown) similar to wheel 14. The flyer spindle 246 has a threaded end portion 248. A double whorled pulley sheave 250 is threaded onto this threaded portion to secure bobbin 244 on the spindle so that the bobbin is freely rotatable on the spindle. Like bobbin 144, bobbin 244 has a plain disk 284 at its end adjacent cross member 256 and a whorled disk 282 at its end adjacent pulley 250. Disk 282 and sheave 250 are driven by pulleys 26, 27 at different speeds as a result of their differing diameters. The bobbin is driven faster and therefore leads the flyer.

Flyer 242 has arms 258, 260 mounted on transverse member 256 and arm 260 incorporates a level wind mechanism. In terms of overall construction, arm 260 closely resembles arms 60, 160. However, the tubular structure of arm 260 is formed by a hollow rectangular wooden member encasing a metal tube 60. Arm 258 is a solid wood member. Except as described below, the level wind mechanism is the same as that used in flyer assemblies 40, 140, like parts being denoted by like reference numerals.

This embodiment of the invention utilizes a somewhat different form of gear train from that used in embodiments of FIGS. 4 and 5. Gear 274 is essentially the same as gear 74. Gear 290 is similar to gear 90 but is not formed as part of bushing 286. Instead, gear 290 is connected to the end face of disk 284 by means of a key 291. Instead of a single large gear, such as gear 78, two smaller gears 278, 279 are connected in a series between gear 290 and gear 274. Gears 278, 279 are both mounted for rotation about an axis parallel to spindle 246 on transverse member 256. This arrangement enables use of a rectangular opening 276 in arm 260 which is somewhat smaller than opening 76.

Having described and illustrated a preferred embodiment of my invention and two variations thereof, it should be readily apparent to those skilled in the art that the invention can be modified in arrangement and detail without departing from its principles. I claim as my invention all modifications coming within the spirit and scope of the following claims.

I claim:

1. A flyer assembly for a spinning wheel, comprising:
   - a flyer having a spindle and an arm, the arm having a free distal end and a proximal end rigidly connected to and radially spaced from the spindle;
   - a bobbin received on the spindle for rotation relative to the flyer and axially removable therefrom;
   - level wind means extending lengthwise of the arm for distributing yarn uniformly along the length of the bobbin; and gear means interconnecting the bobbin and the level wind means for driving the level wind means upon relative rotation of the bobbin and the flyer;

the gear means being positioned adjacent the proximal end of the arm, the gear means including a first gear mounted on an axial end face of the bobbin concentrically of the spindle, the first gear being axially disengageable from the gear means, whereby the bobbin can be removed axially from the spindle in the direction of the free distal end of the arm without disassembling the flyer assembly.

2. A flyer assembly according to claim 1 in which the bobbin includes a different sized whorl at each end so that the bobbin can be reversed for operation at two different speeds, a first gear being mounted on each axial end face of the bobbin for interchangeable engagement in said gear means.

3. A flyer assembly according to claim 1 in which the level wind means includes a cross-threaded elongated member rotatable by the drive means, a traveler means threaded on the member for longitudinal back and forth movement, means defining an eye mounted on the traveler means for guiding yarn lengthwise along the arm, and means extending lengthwise of said cross-threaded member in a predetermined angular position for retaining the traveler against rotation about said member.

4. A flyer assembly according to claim 3 in which said arm comprises a rigid tubular member enclosing the elongated member and providing support therefor, the elongated member being journaled for rotation in the ends of the tubular member, and a slot extending lengthwise of the tubular member for the eye to travel along, a side of the slot defining said retaining means; said gear means including a second gear drivingly mounted on the elongated member within said tubular member.

* * * * *